US006032452A

United States Patent [19]

Zott

[11] Patent Number: 6,032,452

[45] Date of Patent: Mar. 7, 2000

[54] STEP BEARING FOR A SHAFT OF AN OPEN-END SPINNING ROTOR AND PROCESS FOR REPLACING SAME

[75] Inventor: Werner Zott, Donzdorf, Germany

[73] Assignee: Spindelfabrik Suessen, Shurr, Stahlecker & Grill GmbH, Germany

[21] Appl. No.: 09/119,009

[22] Filed: Jul. 20, 1998

[30] Foreign Application Priority Data

Aug. 8, 1997 [DE] Germany ..... 197 34 425

[51] Int. Cl.[7] ..... D01H 4/00

[52] U.S. Cl. ..... 57/406; 384/610

[58] Field of Search ..... 384/610; 57/404, 57/406

[56] References Cited

U.S. PATENT DOCUMENTS

| | | | |
|---|---|---|---|
| 4,105,265 | 8/1978 | Stahlecker | 57/406 |
| 4,106,192 | 8/1978 | Stahlecker | 308/172 |
| 4,618,273 | 10/1986 | Goetz et al. | 384/606 |
| 5,426,931 | 6/1995 | Beitzinger et al. | 57/406 |
| 5,450,718 | 9/1995 | Knabel et al. | 57/406 |
| 5,855,110 | 1/1999 | Bock et al. | 57/406 |

FOREIGN PATENT DOCUMENTS

| | | | |
|---|---|---|---|
| 4325305 | 2/1994 | Germany | 57/406 |

*Primary Examiner*—William Stryjewski
*Attorney, Agent, or Firm*—Evenson, McKeown, Edwards & Lenahan, P.L.L.C.

[57] ABSTRACT

A step bearing is provided for the end of the shaft of an open-end spinning rotor. The step bearing has a cartridge which is clamped fixedly by a cylindrical outer surface in a corresponding hollow cylindrical receiver surface of a supporting part. The cartridge includes a freely rotatable supporting ball for supporting the shaft; a thrust bearing screwed fixedly onto the cartridge for supporting the supporting ball; and a take-up receptacle for lubricating grease. The cartridge, including the supporting ball and the thrust bearing, can be exchanged for another cartridge with fresh lubricating grease.

30 Claims, 1 Drawing Sheet

STEP BEARING FOR A SHAFT OF AN OPEN-END SPINNING ROTOR AND PROCESS FOR REPLACING SAME

BACKGROUND AND SUMMARY OF THE INVENTION

This application claims the priority of German application 197 34 425.9, filed in Germany on Aug. 8, 1997, the disclosure of which is expressly incorporated by reference herein.

The present invention relates to a step bearing for a shaft of a spinning rotor, which in use is loaded with an axial force. A freely rotatable supporting ball is disposed against a thrust bearing, against which supporting ball the shaft is supported by means of a front end supporting surface. The supporting ball is housed in a take-up receptacle for lubricating grease fed to the supporting surface.

U.S. Pat. No. 4,618,273 discloses a step bearing of the above mentioned type. Here the take-up receptacle for the lubricating grease is a part of a larger housing, which also contains a collecting container for used lubricating grease. When the available lubricating grease is used up, fresh lubricating grease can be applied to the take-up receptacle with the aid of a correspondingly formed lubricating grease injector. The take-up receptacle is not disassembled for this purpose. In a variation of the known step bearing, the collecting container can be disassembled for cleaning purposes. Subsequent lubrication in the case of the known step bearing is labor intensive and requires special equipment.

It is an object of the present invention to design a step bearing of the above mentioned type so that subsequent lubrication is simplified.

This object has been achieved in accordance with the present invention in that the take-up receptacle for lubricating grease is arranged in a cartridge, which is clamped fixedly by means of a cylindrical outer surface in a corresponding hollow cylindrical take-up surface of a stationary supporting part, whereby the cartridge further comprises the freely rotatable supporting ball for supporting the end of the shaft, as well as the thrust bearing which is screwed onto the cartridge.

It is thus possible, after the lubricating grease has been used up, to exchange the cartridge for a cartridge with fresh lubricating grease in a simple way. The cartridge is not dismantled when it is disassembled, rather the supporting ball remains in the cartridge. A new cartridge with the necessary supply of lubricating grease and also comprising a supporting ball is assembled.

Although the cartridge can be designed as a disposable part, it is often worth using at least the screw-on thrust bearing and possibly also the unworn supporting ball again. For this reason, the used cartridge can be accordingly prepared for reuse outside of the open-end spinning aggregate.

For the purpose of the present invention, the cylindrical outer surface has a diameter of approximately 14 mm. It is thus possible in the case of known machines to replace an aerostatic axial bearing for the shaft of the spinning rotor with a step bearing comprising the cartridge without any difficulties, whereby namely a bearing tube arranged to the aerostatic axial bearing is taken out of the hollow cylindrical take-up surface after the clamp has been released and replaced by insertion of the cartridge. This process for replacing an aerostatic axial bearing by means of the step bearing of the present invention is in particular advantageous for retrofitting and modernizing older open-end spinning machines. A replaceable, aerostatic axial bearing of this type is disclosed in U.S. Pat. No. 5,450,718.

BRIEF DESCRIPTION OF THE DRAWINGS

These and further objects, features and advantages of the present invention will become more readily apparent from the following detailed description thereof when taken in conjunction with the accompanying drawings wherein.

DETAILED DESCRIPTION OF THE DRAWINGS

Figure 1:
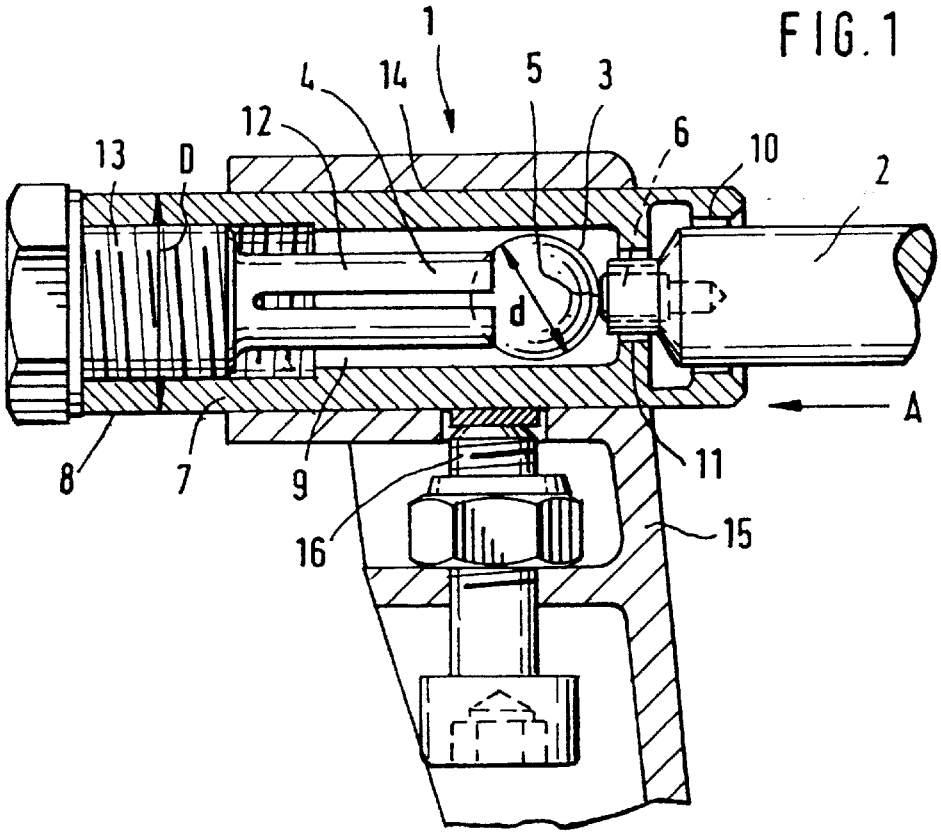
FIG. 1 is a longitudinal sectional view through a step bearing constructed according to a preferred embodiment of the present invention, whose cartridge is fixedly clamped in a hollow cylindrical take-up surface of a stationary supporting part.

The step bearing 1 shown in FIG. 1 is a component of an open-end spinning aggregate (not shown), which includes a spinning rotor comprising a shaft 2 and a rotor cup (not shown). The shaft 2 is supported in a way not shown in a radial bearing, which takes the form of a so-called supporting disk bearing. Such a supporting disk bearing consists in a known way of four supporting disks arranged in pairs, whereby each pair of these supporting disks forms a wedge-shaped gap, in which the shaft 2 is disposed. Using appropriate means, in particular by slightly slanting the axles of the supporting disk pairs, an axial force A is exerted on the end of the shaft 2.

The step bearing 1 serves to take up the axial forces of the horizontally arranged shaft 2, which step bearing 1 comprises a freely rotatable supporting ball 3 and a thrust bearing 4, which has a concave surface adapted to the supporting ball 3. In the operational position of the spinning rotor, the shaft 2 is supported by its front end supporting surface 5 on the supporting ball 3 and presses same into the concave receiver of the thrust bearing 4. The supporting surface 5 is formed by the front surface of a ceramic pin 6, which is housed in a centrical bore hole at the end of the shaft 2.

It has been shown that grease lubrication is particularly effective when the supporting surface 5, as in the embodiment of the present invention, is made of a ceramic material. Another material, for example hardened steel, can also be used for the supporting surface 5.

The step bearing 1 is housed in a cartridge 7, which has a cylindrical outer surface 8. The cartridge 7 comprises a take-up receptacle 9 for lubricating grease.

The shaft 2 projects with its end through two sealed openings 10 and 11 in the cartridge 7 into the take-up receptacle 9.

The thrust bearing 4 is designed in the form of a type of slit tuning fork 12, which, by means of its vibrations, drives the supporting ball 3 during operation to irregular rotations. On the side facing away from the supporting ball 3, the tuning fork 12 graduates over into a screw bolt 13, which is screwed into the end of the cartridge 7.

A hollow cylindrical take-up surface 14 of a stationary supporting part 15 arranged at the spinning machine is arranged at the cylindrical outer surface 8 of the cartridge 7. The cartridge 7 can be inserted against the direction of the axial force A into the take-up surface 14 and clamped fixedly by means of a clamping screw 16, whereby the clamping screw 16 is effective in radial direction of the cartridge 7.

When the lubricating grease present in the take-up receptacle 9 is used up, the cartridge 7 can be taken out of supporting part 15 after the clamping screw 16 has been loosened, in FIG. 1, to the left. The supporting ball 3 and the screwed on thrust bearing 4 arranged in the cartridge 7 are also removed.

The old cartridge 7 can be exchanged for a completely new cartridge containing fresh lubricating grease. Alternatively it is also possible to dismantle the old cartridge 7 outside of the open-end spinning machine and to prepare it for reuse, whereby when the fresh lubricating grease has been poured in, the thrust bearing 4 and if required also the supporting ball 3 can be used again.

The cylindrical outer surface 8 has an outer diameter D of preferably 14 mm, so that the cartridges 7 can be inserted into hollow cylindrical take-up surfaces 14 of known open-end spinning aggregates. The diameter d of the supporting ball 3 should be as large as possible; however, due to prevailing structural dimensions, it is limited to approximately 8 mm.

Figure 2:
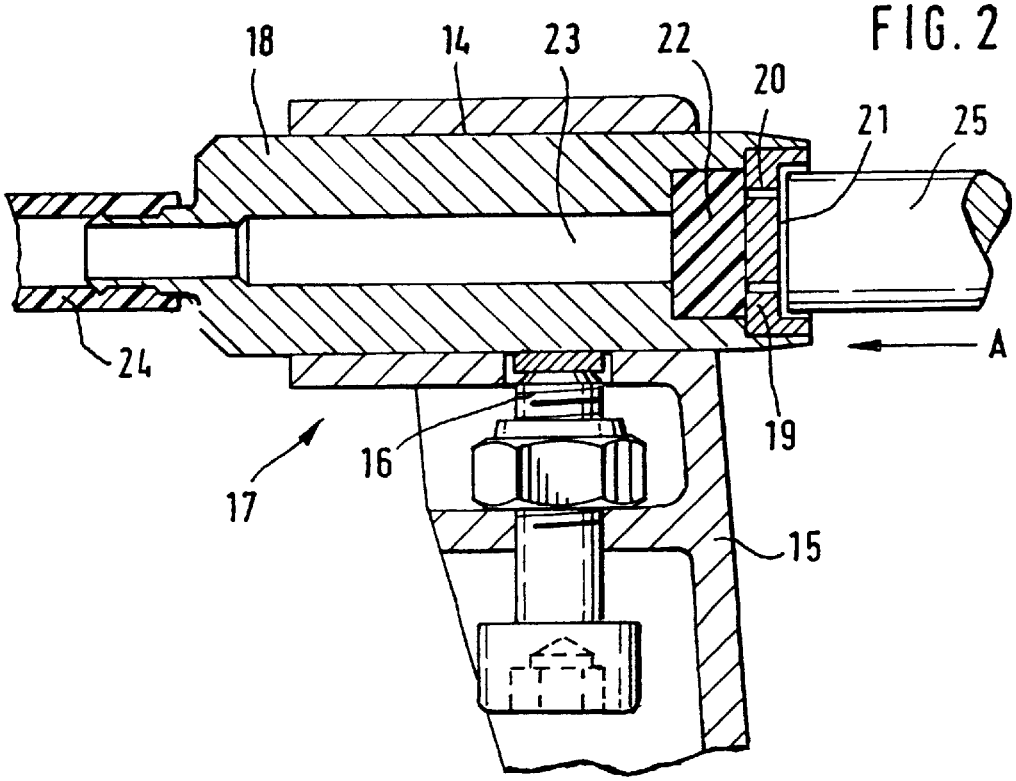
FIG. 2 is a longitudinal sectional through an aerostatic axial bearing, which is clamped by means of a bearing tube in the same supporting part.

There are open-end spinning aggregates, which according to FIG. 2, have the same supporting part 15 as well as the same hollow cylindrical take-up surface 14 as in FIG. 1 but are not provided with a mechanical step bearing 1, but rather with an aerostatic axial bearing 17 for a shaft 25. Such an aerostatic axial bearing 17 can be fixedly clamped with a bearing tube 18 by means of the same clamping screw 16 in the take-up surface 14. The bearing tube 18 comprises at its end facing the shaft 25 a bearing plate 19 comprising air bore holes 20. The bearing plate 19 is connected by means of a choke 22 to an air inlet channel 23 in the inside of the bearing tube 18. The air inlet channel 23 is connected to a flexible compressed air supply 24.

In order to replace the aerostatic axial bearing 17, the bearing tube 18 is removed from the take-up surface 14 after the clamping screw 16 has been loosened, and replaced by a cartridge 7. The shaft 25 adapted to the aerostatic axial bearing 17 must, of course, be replaced by a shaft 2 adapted to the step bearing 1.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A process for replacing an aerostatic axial bearing for a shaft of an open-end spinning rotor by means of a mechanical step bearing comprising:

disassembling a bearing tube comprising the aerostatic axial bearing, which bearing tube is fixedly clamped in a hollow cylindrical take-up surface or a stationary supporting part, including loosening the clamp, and inserting a replacement cartridge of a mechanical step bearing having a cylindrical outer surface into the take-up surface and affixing same by clamping, wherein the cartridge comprises a freely rotatable supporting ball for supporting a newly inserted shaft, a thrust bearing for supporting the supporting ball as well as a take-up receptacle for lubricating grease.

2. A process according to claim 1, wherein the cartridge is affixed in the supporting part by means of a clamping screw effective in a radial direction.

3. A step bearing for a shaft of an open-end spinning rotor, comprising:

a replaceable cartridge forming a supply chamber filled with lubricating grease, a ball disposed in the cartridge, said ball in use being engageable with an end of a rotor shaft assembly, a counterbearing in the cartridge which in use abuts said ball at a side opposite the end of the rotor shaft assembly, a recess in the cartridge which is smaller than the ball and which accommodates insertion of the rotor shaft end, and a clamp operable to clamp the cartridge in an in use position at a spinning machine support part.

4. A step bearing according to claim 3, wherein the replaceable cartridge has a cylindrical outer surface which has a diameter of approximately 14 mm.

5. A step bearing according to claim 4, wherein the supporting ball has a diameter of maximum 8 mm.

6. A step bearing according to claim 4, wherein the counterbearing is screwed to the cartridge.

7. A step bearing according to claim 4, wherein the cartridge is configured to be disassembled in a direction of axial force against the ball exerted in use by a rotor shaft.

8. A step bearing according to claim 7, wherein the counterbearing is screwed to the cartridge.

9. A step bearing according to claim 8, wherein the clamp includes a clamping screw effective in a radial direction, said radial direction being transverse to a rotational axis of an open end spinning rotor shaft supported by the step bearing when in an in use position.

10. A step bearing according to claim 4, wherein the clamp includes a clamping screw effective in a radial direction, said radial direction being transverse to a rotational axis of an open end spinning rotor shaft supported by the step bearing when in an in use position.

11. A step bearing according to claim 3, wherein the supporting ball has a diameter of maximum 8 mm.

12. A step bearing according to claim 11, wherein the counterbearing is screwed to the cartridge.

13. A step bearing according to claim 11, wherein the cartridge is configured to be disassembled in a direction of axial force against the ball exerted in use by a rotor shaft.

14. A step bearing according to claim 11, wherein the clamp includes a clamping screw effective in a radial direction, said radial direction being transverse to a rotational axis of an open end spinning rotor shaft supported by the step bearing when in an in use position.

15. A step bearing according to claim 3, wherein the counterbearing is screwed to the cartridge.

16. A step bearing according to claim 15, wherein the cartridge is configured to be disassembled in a direction of axial force against the ball exerted in use by a rotor shaft.

17. A step bearing according to claim 15, wherein the clamp includes a clamping screw effective in a radial direction, said radial direction being transverse to a rotational axis of an open end spinning rotor shaft supported by the step bearing when in an in use position.

18. A step bearing according to claim 3, wherein the cartridge is configured to be disassembled in a direction of axial force against the ball exerted in use by a rotor shaft.

19. A step bearing according to claim 18, wherein the clamp includes a clamping screw effective in a radial direction, said radial direction being transverse to a rotational axis of an open end spinning rotor shaft supported by the step bearing when in an in use position.

20. A step bearing according to claim 3, wherein the clamp includes a clamping screw effective in a radial direction, said radial direction being transverse to a rotational axis of an open end spinning rotor shaft supported by the step bearing when in an in use position.

21. A step bearing according to claim 3, wherein said clamp includes a threaded clamping member.

22. A replaceable cartridge assembly for a step bearing for a shaft of an open-end spinning rotor, comprising:

a replaceable cartridge forming a supply chamber filled with lubricating grease, a ball disposed in the cartridge, said ball in use being engageable with an end of a rotor shaft assembly, a counterbearing in the cartridge which in use abuts said ball at a side opposite the end of the rotor shaft assembly, and a recess in the cartridge which is smaller than the ball and which accommodates insertion of the rotor shaft end.

23. A replaceable cartridge assembly according to claim 22, wherein said cartridge has a cylindrical outer surface which in use is supported in a cylindrical support surface of a spinning machine supporting part.

24. A replaceable cartridge assembly according to claim 22, wherein said counterbearing is disposed on a member connected to the cartridge by a screw threaded connection.

25. A replaceable cartridge assembly according to claim 24, wherein said cartridge has a cylindrical outer surface which in use is supported in a cylindrical support surface of a spinning machine supporting part.

26. A replaceable cartridge assembly according to claim 22, wherein an end of said cartridge opposite said ball is closed by a detachable closing member.

27. A replaceable cartridge assembly according to claim 26, wherein said cartridge includes a cartridge housing surrounding the supply chamber, and wherein said detachable closing member is connected to said cartridge housing by a screw threaded connection.

28. A replaceable cartridge assembly according to claim 27, wherein said closing member is integrally formed with the counterbearing.

29. A replaceable cartridge assembly according to claim 28, wherein said cartridge housing has a cylindrical outer surface which in use is supported in a cylindrical support surface of a spinning machine supporting part.

30. A replaceable cartridge assembly according to claim 26, wherein said cartridge has a cylindrical outer surface which in use is supported in a cylindrical support surface of a spinning machine supporting part.

* * * * *